US005505826A

United States Patent [19]

Haglin et al.

[11] Patent Number: 5,505,826

[45] Date of Patent: Apr. 9, 1996

[54] HYDROPHILIC ANODE CORROSION CONTROL SYSTEM

[76] Inventors: Patrick G. Haglin, 20360 Paradise Lake Rd. NE., Woodinville, Wash. 98072; Stuart J. Ell, 8116 NE. 131st, Kirkland, Wash. 98034

[21] Appl. No.: 347,041

[22] Filed: Nov. 30, 1994

[51] Int. Cl.[6] ..... C23F 13/00

[52] U.S. Cl. ..... 205/731; 204/196; 204/197; 205/733; 205/735; 205/740

[58] Field of Search ..... 204/147, 148, 204/196, 197

[56] References Cited

U.S. PATENT DOCUMENTS

| | | | |
|---|---|---|---|
| 1,842,541 | 1/1932 | Cumberland | 204/147 |
| 2,495,466 | 1/1950 | Miller | 204/197 |
| 2,810,690 | 10/1957 | Campise et al. | 204/197 |
| 3,616,421 | 10/1971 | Mackintosh | 204/197 |
| 3,649,492 | 3/1972 | Marsh et al. | 204/148 |
| 3,887,449 | 6/1975 | Baer | 204/148 |
| 4,133,737 | 1/1979 | Trimble | 204/197 |
| 4,318,787 | 3/1982 | Peterson et al. | 204/147 |
| 4,435,263 | 3/1984 | Lau | 204/197 |
| 4,623,435 | 11/1986 | Nebgen et al. | 204/148 |
| 4,861,449 | 8/1989 | St. Onge | 204/197 |
| 4,980,043 | 12/1990 | Tomita et al. | 204/414 |
| 5,040,599 | 8/1991 | Pfalser et al. | 166/248 |
| 5,071,537 | 12/1991 | Yamaguchi et al. | 204/414 |
| 5,080,773 | 1/1992 | Tatum, Jr. et al. | 204/196 |
| 5,167,785 | 12/1992 | McCready | 204/196 |
| 5,316,641 | 5/1994 | Wright et al. | 204/197 |

OTHER PUBLICATIONS

Kroon, D. H., Technical Paper CP–32, originally presented at the National Association of Corrosion Engineers, "Cathodic Protection Anodes Underground", Mar. 1984, Revised May 1989.

Author unknown, "Corrosion and Cathodic Protection Theory", Section II, pp. 22–31, date unknown.

Harco Technologies Corporation, "Tank–Pak® Cathodic Protection for Underground Storage Tanks and Piping", date unknown.

American Petroleum Institute, "Cathodic Protection of Underground Petroleum Storage Tanks and Piping Systems", Publication 1632, First Edition 1983.

Harco Corporation, "Corrosion Control Through Cathodic Protection Engineering", date unknown.

Author Unknown, "Sacrificial Anodes", pp. 24–25, 38–39, 42–43, and Cathodic Protection Systems, pp. 138–143, date unknown.

*Primary Examiner*—T. Tung
*Attorney, Agent, or Firm*—Christensen O'Connor Johnson & Kindness

[57] ABSTRACT

A method and apparatus for reducing corrosion on the interior and exterior of a fuel storage tank. A galvanic anode assembly is placed within the interior of or exterior to the fuel storage tank and is surrounded by a layer of hydrophilic gel. The hydrophilic gel absorbs water in the fuel storage tank, thus removing it from contact with the tank. The hydrophilic gel also absorbs metal ions produced as the anode is consumed. The hydrophilic gel is maintained around the anode assembly by a porous container. The anode, hydrophilic gel, and porous container are maintained within a flexible container that allows water and fluid contained within the fuel storage tank to contact the hydrophilic gel. In one embodiment, the hydrophilic gel includes a polyacrylamide material.

9 Claims, 2 Drawing Sheets

HYDROPHILIC ANODE CORROSION CONTROL SYSTEM

FIELD OF THE INVENTION

This invention relates to cathodic protection systems for metallic structures, and more specifically to galvanic anode cathodic protection systems for use with fuel or other liquid storage tanks.

BACKGROUND OF THE INVENTION

Most metals are reactive in electrolytic environments, such as the type of environment present in damp soil or water resulting in electrolytic corrosion. Electrolytic corrosion presents a particular problem for liquid storage tanks formed of metal, because corrosion can create holes, allowing the tanks to leak. Electrolytic corrosion is a particularly acute problem in metal liquid storage tanks such as the tanks used to store petroleum fuels at storage sites or service stations.

It's estimated that 3 to 5 million metal underground storage tanks are in service today. Failure or leakage of such tanks can have dramatic ramifications under current local, state and federal government regulations. In addition, storage tank failures due to corrosion and the resulting replacement costs dramatically impact the costs associated with their use and maintenance. Methods to increase the life of metal storage tanks and to decrease failures have a large impact on the operating and maintenance costs.

Electrolytic corrosion occurs on both the interior and exterior of fuel storage tanks. Basically, a corrosion cell is formed between different areas on the internal and external surfaces of the fuel storage tank. Variations in electrochemical activity or potential between one area on the interior or exterior surface of a tank and another area cause a corrosion cell to be formed between the areas. Although corrosion is most common on the exterior of a storage tank, it can also be a problem on the interior of the storage tank.

In order to minimize electrolytic corrosion problems, cathodic protection systems using either impressed current or galvanic protection are connected to the exterior of storage tanks. The galvanic anodes are formed of a metal that has a higher Electromotive Force than the material used to form the structure of the storage tank. Thus, current passes from the galvanic anode to the surface being protected, consuming the anode while preventing corrosion of the protected surface. Galvanic anodes used in tanks formed of ferrous materials such as steel are commonly formed of magnesium or zinc. There are a number of other anode materials that may be used, depending upon the application. The best anode material, and thus galvanic efficiency, depends upon the application.

Galvanic anodes are sacrificial elements that slowly corrode or are consumed in an electrolytic environment. Galvanic anodes may be consumed due to galvanic metal oxidation, which involves oxygen evolution and chlorine evolution. Because galvanic anodes are higher in Electromotive Force than the metal being protected, the corrosion or breakdown of the anode prevents the breakdown of the protected metal. In effect, the protected metal becomes a cathode of an electrolytic cell whose anode is formed by the sacrificial metal, i.e., "cathodic protection."

In cathodic protection systems using impressed current, small amounts of direct current are passed continuously from sacrificial anodes to the metallic structure to be protected. Controlling the amount of current passed between the anodes and the metallic surface halts the external loss of metal when the tank electrochemically reacts with its environment. Instead of the metal surface being protected from corroding, the sacrificial anode is corroded or consumed.

Cathodic protection of the exterior surface of a storage tank helps to prevent corrosion on only the exterior surface of the tank, but it does not prevent the interior surface of the storage tank from being corroded. Thus, to ensure that a storage tank does not fail due to interior corrosion, it would be beneficial to cathodically protect the interior surface of the tank as well as the exterior surface of the storage tank.

Galvanic anodes have not been commonly or effectively used inside storage tanks for a number of reasons. Sacrificial galvanic anodes release metal ions which can combine with water to form corrosive salts as the anodes break down. These corrosive salts can contaminate the liquid in a storage tank. If the liquid is refined fuel, the corrosive salts can make the fuel unusable for internal combustion engines. Specifically, corrosive salts can cause significant damage to the engine. Because the interior of a metal fuel storage tank is not cathodically protected, it is highly susceptible to interior corrosion, which can lead to fuel leakage, and thus costly environmental concerns.

As the petroleum industry becomes more environmentally conscious, there is increasing pressure to eliminate metal fuel storage tanks that may be susceptible to interior and exterior corrosion, and thus to possible petroleum leaks into the surrounding soil. This has led the petroleum industry to replace some underground metal fuel storage tanks at service stations and other locations with nonmetallic storage tanks formed of plastic or another polymerized or noncorrosive material. Nonmetallic fuel storage tanks are generally not as damage-tolerant or forgiving as metal fuel storage tanks, especially during earthquakes.

Because galvanic anodes must be replaced when the anode metal becomes sufficiently consumed, an anode within a storage tank should be easily replaceable. Further, in order to be effective, a galvanic anode must be positionable in the region where water accumulates in a storage tank, namely at the bottom of the tank. More specifically, because water is heavier than petroleum products, water tends to accumulate at the bottom of a storage tank underneath any fuel in the tank. In order for a galvanic anode to work efficiently, it should be located in direct contact with any water in the tank. Only by being located in the water will a low-resistance electrical circuit be created. If a low-resistance electrical circuit is not formed between the galvanic anode and the interior surface of the fuel tank, the galvanic anode will not effectively prevent the corrosion of the interior surface of the fuel tank.

Thus, there exists a need for cathodic protection systems that reduce or eliminate corrosion problems on the exterior and interior surfaces of metal fuel storage tanks such as those used at fuel storage sites or service stations. Such protection systems would allow fuel storage tanks formed of metal to be safely used without worry of corrosion, thus reducing the need for expensive and less damage tolerant plastic fuel storage tanks. As will be better understood from the following discussion, the invention provides a cathodic anode assembly that addresses some of the problems discussed above.

SUMMARY OF THE INVENTION

In accordance with the present invention, a galvanic anode assembly suitable for use inside of metal storage tanks, particularly above or below ground petroleum metal storage tanks, is provided. The anode assembly includes standard materials, such as magnesium or zinc, as sacrificial anode elements to prevent corrosion on the interior of a metal storage tank. The sacrificial anode element material is surrounded by a hydrophilic gel that maintains a layer of water around the sacrificial anode element material. The hydrophilic gel surrounding the sacrificial anode element contains metal ions produced during consumption of the sacrificial anode element. Because metal ions are absorbed by and maintained within the hydrophilic gel, they do not combine to form corrosive salts that can contaminate fuel contained within the storage tank.

The hydrophilic gel is maintained around the exterior surface of the sacrificial anode element by a porous bag or other porous structure that is capable of maintaining the hydrophilic gel around the anode element, while allowing water to pass through the bag and into the hydrophilic gel. The combined anode elements, hydrophilic gel, and porous bag may in turn be placed within a flexible, protective structure, such as a plastic pipe containing holes. The resulting galvanic anode assembly is easily insertable through the fuel filling tube on a fuel storage tank. Maintaining a layer of water around the anode material has the advantage of increasing the efficiency of the anode assembly by providing a low-resistance electrical path between the anode assembly and the interior surface of the storage tank near the anode. The increased efficiency of the sacrificial anode helps improve galvanic corrosion prevention.

In accordance with other aspects of the invention, the galvanic anode assembly is lowered into a fuel storage tank so as to rest on the bottom of the storage tank where water is located if the tank contains any water. The sacrificial anode is electrically connected to the storage tank.

In accordance with further aspects of this invention, the galvanic anode assembly includes a porous structure that maintains the hydrophilic gel around the sacrificial anode element so that the hydrophilic gel absorbs metal ions produced during consumption of the anode.

In accordance with still other aspects of this invention, the porous structure is a porous bag that houses both the anode elements and the hydrophilic gel.

In accordance with still further aspects of this invention, the galvanic anode assembly includes a flexible plastic pipe and the porous bag is located in the flexible plastic pipe. The plastic pipe includes a series of slits or holes that allow water to enter the plastic pipe, flow through the porous bag, and be absorbed by the hydrophilic gel.

In accordance with still other aspects of this invention, a series of sacrificial anode elements are electrically connected together to form an anode assembly of any desired length for use in tanks of varying sizes.

In addition to being used as a galvanic anode in the interior of a tank, the present invention may also be used in either a galvanic or impressed current configuration to prevent corrosion on the exterior surface of a storage tank. In one embodiment of this application, a galvanic anode assembly is buried in the ground in the proximity of the storage tank and is electrically connected to the exterior surface of the storage tank. A layer of hydrophilic gel is mixed with the soil around the anode assembly. The hydrophilic gel attracts and maintains water around the anode, thus increasing its efficiency.

In another embodiment, the anode assembly is buried in the ground in the proximity of the storage tank and is electrically connected to a DC power source. A layer of hydrophilic gel is mixed with the soil around the anode assembly to create an improved electrolyte and ensure an efficient low-resistance electrical path between the anode assembly and the surrounding soil. The DC power source is in turn electrically connected to the storage tank. The power source provides a driving force that helps move current between the anode assembly and the exterior surface of the storage tank.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
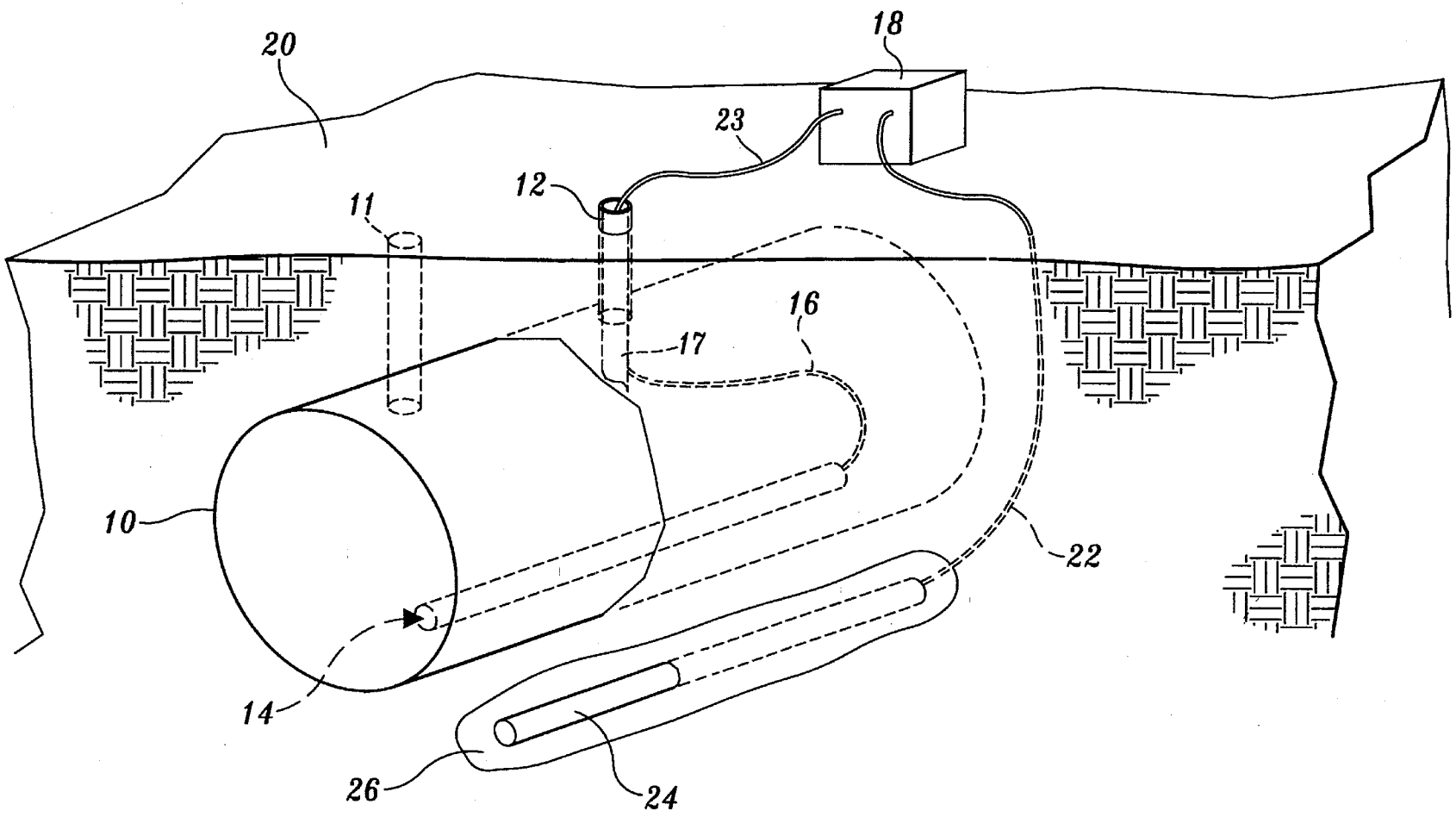
FIG. 1 is a schematic partial cutaway view of a buried fuel tank assembly incorporating both interior and exterior anode assemblies formed in accordance with this invention.

FIG. 1 illustrates a fuel storage tank 10 in combination with an interior 14 and an exterior 24 galvanic anode assembly formed in accordance with the present invention. The fuel storage tank 10 shown is a cylindrical fuel storage tank formed of metal, such as iron, and is typical of the type of underground fuel storage tanks used to store fuel at service (i.e., gas) stations, etc. The storage tank 10 includes a venting tube 11 and a fuel filler tube 12 that extend upwardly from the fuel tank to the surface of the ground 20 in which the tank is buffed.

Although the invention is illustrated for use with underground fuel storage tanks, it may be used with either underground or above-ground fuel storage tanks. In addition, the invention may be used in tanks used to store substances other than fuel.

Corrosion of the interior surface of the storage tank 10 is prevented by the interior galvanic anode assembly 14, which is placed inside the storage tank and electrically connected to the tank by an electrical cable 16. More specifically, one end of the cable 16 is connected to one end of the galvanic anode assembly 14. The other end of the cable is electrically connected to a metal tube 17. The tube 17 passes through the filler tube 12 extending from the top of the fuel filler tube 12 downward at least partially into the interior of the tank 10. The tube 17 is electrically conductive and is electrically connected to the storage tank 10 by being connected to the filler tube 12. The galvanic anode assembly is sized to be inserted into the tank 10 via the filler tube 12. The electrical cable 16 is long enough to allow the galvanic anode assembly 14 to be lowered to the bottom of the tank and to lie along the bottom, as shown.

The external anode assembly 24 is buried below the surface of the ground 20 in the proximity of the storage tank. In the preferred embodiment illustrated, one end of the exterior anode assembly 24 is connected by electrical cable 22 to one terminal of an option DC power supply 18. The other terminal of the DC power supply 18 is in turn electrically connected to the exterior surface of the tank 10 by an electrical cable 23 connected to filler tube 12. The exterior anode assembly 24 helps to prevent corrosion of the exterior of the tank 10.

Figure 2:
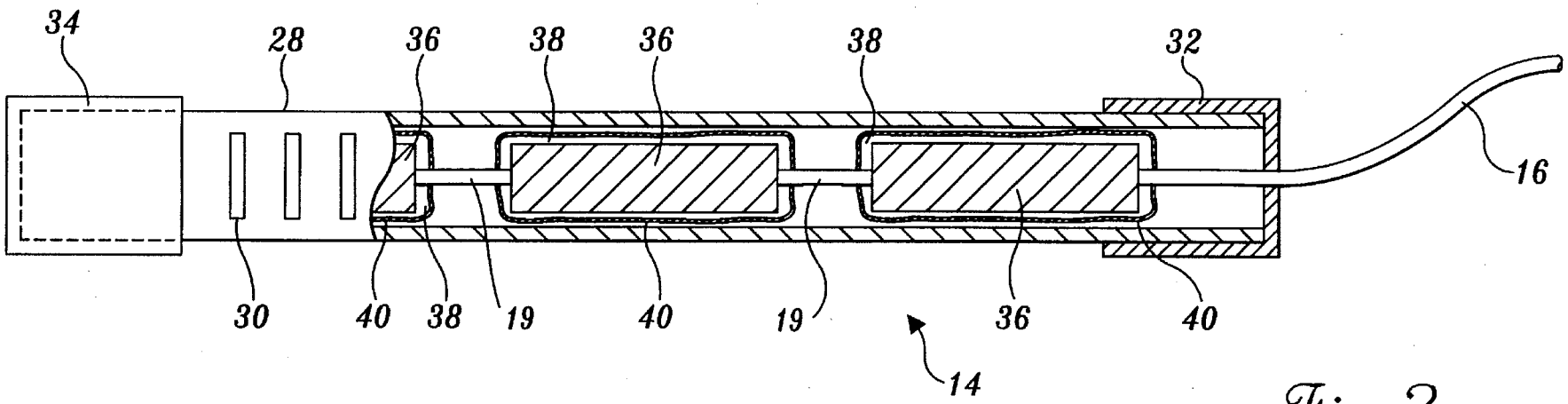
FIG. 2 is a side partial cutaway view of the internal galvanic anode assembly of FIG. 1.

The structure of the internal galvanic anode assembly 14 will now be described with reference to FIG. 2. The internal galvanic anode assembly 14 includes one or more sacrificial anode elements 36 that are electrically connected to the cable 16. More specifically the anode elements 36 are electrically connected in series by connecting cables 19, as shown in FIG. 2. One of the outer anode elements 36 of the series is electrically connected to one end of the cable 16. The number of anode elements 36 used, and the size and shape of the anode elements, are determined by the geometry of a protective container 28 (described below) in which they are placed and the geometry of the fuel tank 10 in which the galvanic anode assembly 14 is used.

Each anode element 36 is surrounded by a layer of hydrophilic material 38. Since hydrophilic material absorbs water, the layer of hydrophilic material 38 maintains a layer of water around the anode elements 36 if there is any water in the interior of the tank 10. The layer of water in the hydrophilic material 38 around the anode elements 36 establishes a low-resistance electrically conductive pathway between the anode elements 36, the water surrounding the galvanic anode assembly 14, and the interior surface of the fuel tank 10. In the preferred embodiment of the invention, the hydrophilic material consists of 99.5% polyacrylamide and less than 0.05% acrylamide. One exemplary hydrophilic gel is sold under the trade name Terr Sorb Ag by Industrial Services International, Inc.

The water absorbed by the hydrophilic material 38 creates an electrolyte around the anode elements 36. The hydrophilic material 38 also helps to absorb metal ions produced as the anode elements 36 are consumed. As a result, the metal ions do not combine with water to form corrosive salts that can enter and contaminate fuel within the tank 10.

In alternate embodiments, hydrophilic materials having different amounts of polyacrylamide or other hydrophilic materials may be used. The chosen hydrophilic material should absorb water to remove the water from contact with the metal interior surface of the tank and lower the resistivity around the sacrificial anode. It is also advantageous that the hydrophilic material absorb the metal ions produced as the anode elements are consumed. The anode elements 36 are, of course, formed of a metal that is higher on the electromotive scale, i.e., higher Electromotive Force than the metal used to form the tank 10. If the tank is formed of a ferrous material, suitable metals for forming the anode elements include zinc and magnesium.

The hydrophilic material 38 is maintained around each anode element 36 by a porous container or bag 40 that surrounds each anode element 36. The bags 40 are formed of a porous material that allows water to pass through the bags into the hydrophilic material 38, but prevents the hydrophilic material from moving through the bag 40 and contaminating fuel within the storage tank 10.

The entire structure consisting of anode elements 36, hydrophilic material 38, and porous bags 40 is contained in a protective container 28. Preferably, the protective container 28 is cylindrical and includes two endcaps 32 and 34 that maintain the anode elements 36 within the interior of the container 28. The protective container 28 includes a plurality of holes, preferably in the form of slots 30 spaced along its length. The slots 30 allow water and fuel to enter the interior of the container 28 while maintaining the anode elements 36 and bags 40 within the container.

The container 28 may be formed from a wide variety of different materials, however, it is advantageous for the container to be formed of a flexible electrically insulating material, such as a plastic or rubber tube. Forming the container 28 of a flexible material and maintaining the length of each individual anode element 36 relatively short allows the entire anode assembly 14 to be flexible over its length. A flexible anode 14 is easier to insert through the fuel filler tube 12 into the fuel storage tank 10 than is a rigid assembly.

In addition to protecting the anode elements 36, bags 40, and hydrophilic gel 38 from damage during insertion or withdrawal, the container 28 also prevents the anode elements 36 from directly contacting the interior of the storage tank 10. This ensures that an electrical connection is not established directly between the interior of the fuel storage tank 10 and the anode elements 36. The container 28 also prevents any water within the hydrophilic gel 38 from contacting the metal interior surface of the tank, thus helping to prevent corrosion.

In order to insert the interior anode assembly 14 into the fuel storage tank 10, the tube 17 is first withdrawn from the storage tank. The anode 14 is then electrically connected to the tube 17 by cable 16 and lowered into the storage tank through the filler tube 12. When it is necessary to withdraw the anode assembly 14 for repair or replacement, it is withdrawn through the filler tube 12.

It is advantageous that the anode assembly 14 be placed adjacent to the bottom of the tank 10. In fuel storage tanks, water is heavier than the fuel and thus accumulates at the bottom of the tank. Placing the anode assembly 14 at the bottom of the tank ensures that the hydrophilic gel will absorb water within the bottom of the tank, thus removing the water from contact with the metal interior surface of the tank.

Figure 3:
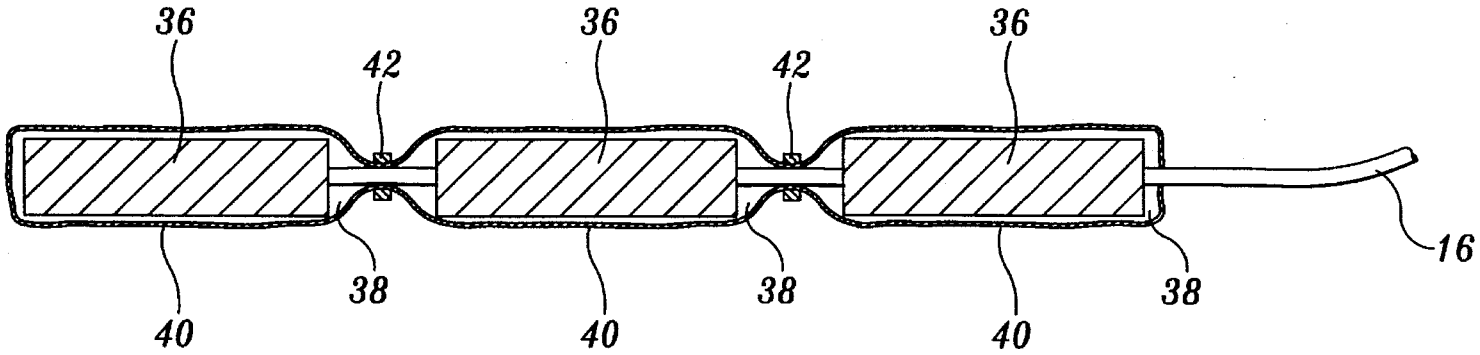
FIG. 3 is a side cutaway view of a second embodiment of a galvanic anode assembly formed in accordance with this invention suitable for use in protecting either the interior or the exterior of a fuel tank or other metal structure.

A second embodiment of the porous bag 40 is illustrated in FIG. 3. In the second embodiment, instead of using individual bags 40 surrounding individual anode elements 36, a continuous bag is placed over all of the anode elements 36. The portions of the bag 40 located between individual anode elements 36 are tied off using ties 42 to establish individual sealed compartments around each anode element 36. Although it is preferred to maintain individual compartments around each anode element 36 to ensure that hydrophilic material 38 surrounds each anode element 36, alternate configurations can be used. For example, a single, undivided bag could surround all the anode elements 36. In other alternate embodiments, the bag 40 could be eliminated altogether, and the interior of the container 28 could be filled with a hydrophilic material. In such an embodiment, the size of the holes or slots 30 and size of hydrophilic material 38 would have to be tailored to ensure that the hydrophilic material does not pass through the slots 30 and contaminate fuel within the storage tank 10.

The structure of the external anode assembly 24 shown in FIG. 1, could be the same as the structure of the interior anode assembly 14 described above. Alternatively, the anode assembly 24 could be of existing anode designs. The efficiency of the anode assembly 24 is increased by surrounding the anode with a hydrophilic gel 26, such as a polyacrylamide material in a gel or crystal form. The hydrophilic gel 26 could be mixed with the soil surrounding the anode assembly 24, for example. The surrounding soil will act as a container that maintains the hydrophilic gel around the anode assembly 24. Alternatively, the hydrophilic gel could be contained around the exterior anode assembly 24 through the use of a porous bag (not shown) in a manner similar to that described with respect to the interior anode assembly 14 described above.

The hydrophilic gel 26 surrounding the anode assembly 24 absorbs and holds water within the soil in the vicinity of the anode. As the hydrophilic gel 26 absorbs water, it creates an improved electrolyte and ensures an efficient low-resistance electrical path between the anode assembly 24 and the surrounding soil. The hydrophilic gel provides the anode assembly 24 with a uniform environment for low-resistance contact to the earth, thus increasing the efficiency of the electrical path.

The exterior anode assembly 24 may be connected in a galvanic protection configuration or an impressed current configuration. In a galvanic configuration, the anode assembly is directly electrically connected (not shown) to the exterior of the storage tank 10 using an electrical cable or other means.

Alternatively, the efficiency of the exterior anode assembly 24 may be increased by connecting it to an optional DC power source 18 in an impressed current configuration, as shown in FIG. 1. The power source 18 is in turn electrically connected to the storage tank 10 through the use of an electrical cable 23 as described above. The power source 18 provides a driving force that helps move current between the anode assembly 24 and the exterior surface of the storage tank 10. The current provided by the power source assists in moving current between the anode assembly 24 and exterior surface of the storage tank 10, thus ensuring that the anode 24 corrodes and is consumed as opposed to the exterior surface of the storage tank.

In alternate embodiments of the invention, the anode elements 36 could be formed of other materials than those described above. In addition, hydrophilic materials other than those specifically described above can be used. Further, geometry of and materials used to form the container 28 can also be altered without departing from the invention. In still other alternate embodiments, the container 28 can be eliminated altogether and other methods used to prevent the anode elements 36 and hydrophilic material from contacting the interior of the tank 10. While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A hydrophilic anode corrosion control system comprising:

a petroleum storage tank; and an anode located at the bottom of the interior of the storage tank and electrically connected to the storage tank, the anode including at least one sacrificial anode element, a hydrophilic gel surrounding the anode element, and a porous container surrounding the hydrophilic gel and anode element to maintain the hydrophilic gel around the anode element and to allow liquid within the storage tank to flow through the container into contact with the hydrophilic gel to allow the hydrophilic gel to absorb water within the storage tank, wherein the porous container prevents contact between the anode element and the interior of the storage tank.

2. The system of claim 1, wherein the hydrophilic gel is formed at least partially of polyacrylamide.

3. The system of claim 1, wherein the porous container includes a porous bag that surrounds the hydrophilic gel and anode element and a porous flexible tube that surrounds the porous bag.

4. The system of claim 3, wherein the flexible tube is formed of an electrically insulating material and wherein the tube is flexible over its length to allow the anode to be inserted into or withdrawn from the storage tank through a mouth of the storage tank.

5. A hydrophilic anode corrosion control system comprising:

an anode located within and electrically connected to a fuel storage tank, the anode including at least one sacrificial anode element, a hydrophilic polyacrylamide gel surrounding the anode element, and a porous container surrounding the hydrophilic polyacrylamide gel and anode element, the porous container maintaining the hydrophilic polyacrylamide gel around the anode element while allowing liquid within the storage tank to flow through the porous container and into contact with the hydrophilic polyacrylamide gel to allow the hydrophilic polyacrylamide gel to absorb water within the storage tank, the porous container maintaining the anode element out of contact with the fuel storage tank and being sufficiently flexible over its length to allow the anode to be inserted and withdrawn through a mouth of the fuel storage tank.

6. The system of claim 5, wherein the porous container includes a porous bag surrounding the hydrophilic polyacrylamide gel and a flexible tube surrounding the porous bag, the flexible tube being formed of an electrically insulating material.

7. A method of absorbing water within a petroleum storage tank and reducing corrosion of the petroleum storage tank, the method comprising:

placing a hydrophilic gel around at least one sacrificial anode element;

surrounding the hydrophilic gel and anode element with a porous container that maintains the hydrophilic gel around the anode element but allows liquid within the storage tank to move through the porous container into contact with the hydrophilic gel to form a hydrophilic anode;

inserting the hydrophilic anode into the storage tank through a mouth of the storage tank so that the hydrophilic anode is located adjacent a bottom of the storage tank, and so that the hydrophilic gel absorbs water located at the bottom of the storage tank; and electrically connecting the anode element to the storage tank.

8. The method of claim 7, wherein the porous container maintains the anode element out of contact with the bottom of the fuel storage tank and is sufficiently flexible over its length to allow the hydrophilic anode to be inserted into or withdrawn from the storage tank through the mouth of the storage tank.

9. The method of claim 8, wherein the porous container comprises a porous bag surrounded by a porus tube that is flexible over its length.

* * * * *